US007487759B2

(12) United States Patent
Ochiai

(10) Patent No.: US 7,487,759 B2
(45) Date of Patent: Feb. 10, 2009

(54) FLOW DAMPER

(75) Inventor: Hiroaki Ochiai, Okazaki (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 11/953,897

(22) Filed: Dec. 11, 2007

(65) Prior Publication Data

US 2008/0156290 A1 Jul. 3, 2008

(30) Foreign Application Priority Data

Dec. 27, 2006 (JP) ..... 2006-353241
Sep. 27, 2007 (JP) ..... 2007-251921

(51) Int. Cl.
*F02M 55/02* (2006.01)
*F02M 55/04* (2006.01)

(52) U.S. Cl. ..... 123/469; 123/510

(58) Field of Classification Search ..... 123/447, 123/198 D, 456, 510, 468, 469; 137/493.6, 137/498, 504, 493.2
See application file for complete search history.

(56) References Cited

U.S. PATENT DOCUMENTS 5,692,476 A * 12/1997 Egler et al. ..... 123/456
6,357,415 B1 3/2002 Mori
7,066,148 B2 * 6/2006 Nishiwaki ..... 123/456
7,216,631 B2 * 5/2007 Nishiwaki et al. ..... 123/467
2006/0090736 A1 * 5/2006 Nishiwaki et al. ..... 123/456

* cited by examiner

*Primary Examiner*—Mahmoud Gimie
(74) *Attorney, Agent, or Firm*—Nixon & Vanderhye PC

(57) ABSTRACT

A flow damper includes a valve body, a piston, a spring, and a cap. The valve body is fastened to the rail main body and has a fuel passage therein. The fuel passage communicates between a fuel hole of the rail main body and the injector. The fuel passage includes a piston sliding hole on its rail main body-side. The piston is slidably held on an inner circumferential surface of the piston sliding hole. The spring urges the piston in an opposite direction from a direction of fuel flowing through the fuel passage. The cap includes a small diameter portion and a large diameter portion. The small diameter portion is fitted into the inner circumferential surface of the piston sliding hole with a gap between the small diameter portion and the piston sliding hole. The large diameter portion is located between the valve body and the rail main body.

3 Claims, 5 Drawing Sheets

FLOW DAMPER

CROSS REFERENCE TO RELATED APPLICATION

This application is based on and incorporates herein by reference Japanese Patent Application No. 2006-353241 filed on Dec. 27, 2006, and Japanese Patent Application No. 2007-251921 filed on Sep. 27, 2007.

BACKGROUND OF THE INVENTION

1. Field of the Invention

The present invention relates to a flow damper.

2. Description of Related Art

A flow damper includes a valve body, a piston, a spring, and a stopper The valve body has a generally cylindrical shape, and a fuel passage is formed in the valve body. The piston slides in its axial direction along a piston sliding hole formed inside the valve body. The spring urges the piston toward an upstream side in a fuel flow direction. The stopper restricts displacement of the piston toward the upstream side (see, for example, JP2001-50141A corresponding to U.S. Pat. No. 6,357,415).

The piston has a throttle passage, which communicates between upstream and downstream sides of the fuel passage. When a fuel flow in the downstream direction in the fuel passage abnormally increases because of malfunction of an injector such as an excessive fuel outflow, the piston is moved toward the downstream side, and a valve portion of the piston engages a valve sheet of the valve body to block the fuel passage. In this manner, the flow damper stops an outflow of high-pressure fuel if some failure is caused by any possibility.

The valve body is fastened to a rail main body, which accumulates pressure of high-pressure fuel. Accordingly, a closely-attached surface between the valve body and the rail main body needs to ensure a highly oil-tight sealing surface. The valve body is fastened by strong axial force and fixed to the rail main body.

The valve body is strongly fastened to the rail main body, so that the valve body on a rail main body-side, to which strong axial force is applied, is strained.

The valve body slidably holds the piston inside the valve body. When the valve body is strained for the above reason and accordingly the piston sliding hole is deformed in a radially inward direction, a sliding clearance between the valve body and the piston is decreased, thereby deteriorating a slide of the piston.

For this reason, as shown in FIG. 6, a stopper J3 is press-fitted into the inside of a valve body J1 to which strong axial force is applied, that is, into an inner circumferential surface of an opening side of a piston sliding hole J2, in order to prevent deformation of the piston sliding hole J2.

In addition, to avoid promotion of pulsing motion generated in an injector pipe by movement of a piston J5, which is involved in a fuel flow generated when the injector (fuel injection valve) injects fuel, an orifice J4 is formed in the stopper J3.

However, since the stopper J3 is press-fitted into the valve body J3 in a production process of the flow damper, a fuel flow cannot be adjusted in the flow damper, which has been produced.

More specifically, when it is examined whether the flow damper that has been produced (in an assy state) works within an appropriate range, the stopper J3 that is press-fitted cannot be separated from the valve body J1 if the flow damper turns out to be faulty (NG). Accordingly, replacement of the stopper J3 (change of a diameter of the orifice in the stopper J3), replacement of the piston J5 (change of a diameter of a throttle passage in the piston J5), and replacement of a spring J6 (change of a set load) cannot be done.

For these reasons, in product management of the flow damper that has been produced, the flow damper itself, which has been produced, needs to be disposed of if the flow damper is outside the appropriate range.

SUMMARY OF THE INVENTION

The present invention addresses the above disadvantages. Thus, it is an objective of the present invention to provide a flow damper, which avoids deterioration of piston slide when a valve body is fastened to a rail main body using strong axial force, and which facilitates flow adjustment.

To achieve the objective of the present invention, there is provided a flow damper for controlling a flow of fuel flowing from a rail main body that accumulates pressure of high-pressure fuel into an injector that injects fuel. The flow damper includes a valve body, a piston, a spring, and a cap. The valve body is fastened to the rail main body and has a fuel passage therein. The fuel passage communicates between a fuel hole of the rail main body and the injector. The fuel passage includes a piston sliding hole on its rail main body-side. The piston is slidably held on an inner circumferential surface of the piston sliding hole. The spring urges the piston in an opposite direction from a direction of fuel flowing through the fuel passage. The cap includes a small diameter portion and a large diameter portion. The small diameter portion is fitted into the inner circumferential surface of the piston sliding hole with a gap between the small diameter portion and the piston sliding hole. The large diameter portion is located between the valve body and the rail main body.

BRIEF DESCRIPTION OF THE DRAWINGS

The invention, together with additional objectives, features and advantages thereof will be best understood from the following description, the appended claims and the accompanying drawings in which:

DETAILED DESCRIPTION OF THE INVENTION

A flow damper according to a first embodiment of the present invention includes a valve body, a piston, a spring, and a cap.

The valve body is fastened to a rail main body for accumulating pressure of high-pressure fuel therein. A fuel passage, which communicates between a fuel hole of the rail main body and an injector pipe, is formed in the valve body. A piston sliding hole for slidably supporting the piston is formed on an upstream side of the fuel passage of the valve body.

The piston is slidably supported in its axial direction on an inner circumferential surface of the piston sliding hole, and is urged toward an upstream side in a fuel flow direction by the spring. A throttle passage, which communicates between upstream and downstream sides of the fuel passage, is formed in the piston. When a fuel flow in the downstream direction in the fuel passage abnormally increases because of malfunction of an injector such as an excessive fuel outflow, a pressure difference between before and after the throttle passage increases. Accordingly, the piston is moved toward the downstream side against urging force of the spring, and a valve portion of the piston engages a valve sheet of the valve body. As a result, the fuel passage is blocked, so that the outflow of high-pressure fuel is stopped if some failure of the flow damper is caused by any possibility.

The cap is attached to an upstream side-portion of the valve body in the fuel flow direction, and includes a small diameter portion, which is fitted into the inner circumferential surface of the piston sliding hole, and a large diameter portion, which is located between the valve body and the rail main body. The cap has an orifice in a communicating portion, through which the fuel hole of the rail main body and the upstream side of the fuel passage communicate. The orifice reduces a flow passage area of the communicating portion. The orifice may be unnecessary.

First Embodiment

In the first embodiment, an example of a common-rail fuel injection system is described with reference to FIG. 3, and after that, a flow damper is explained with reference to FIGS. 1, 2.

(Common-rail Fuel Injection System)

Figure 3:
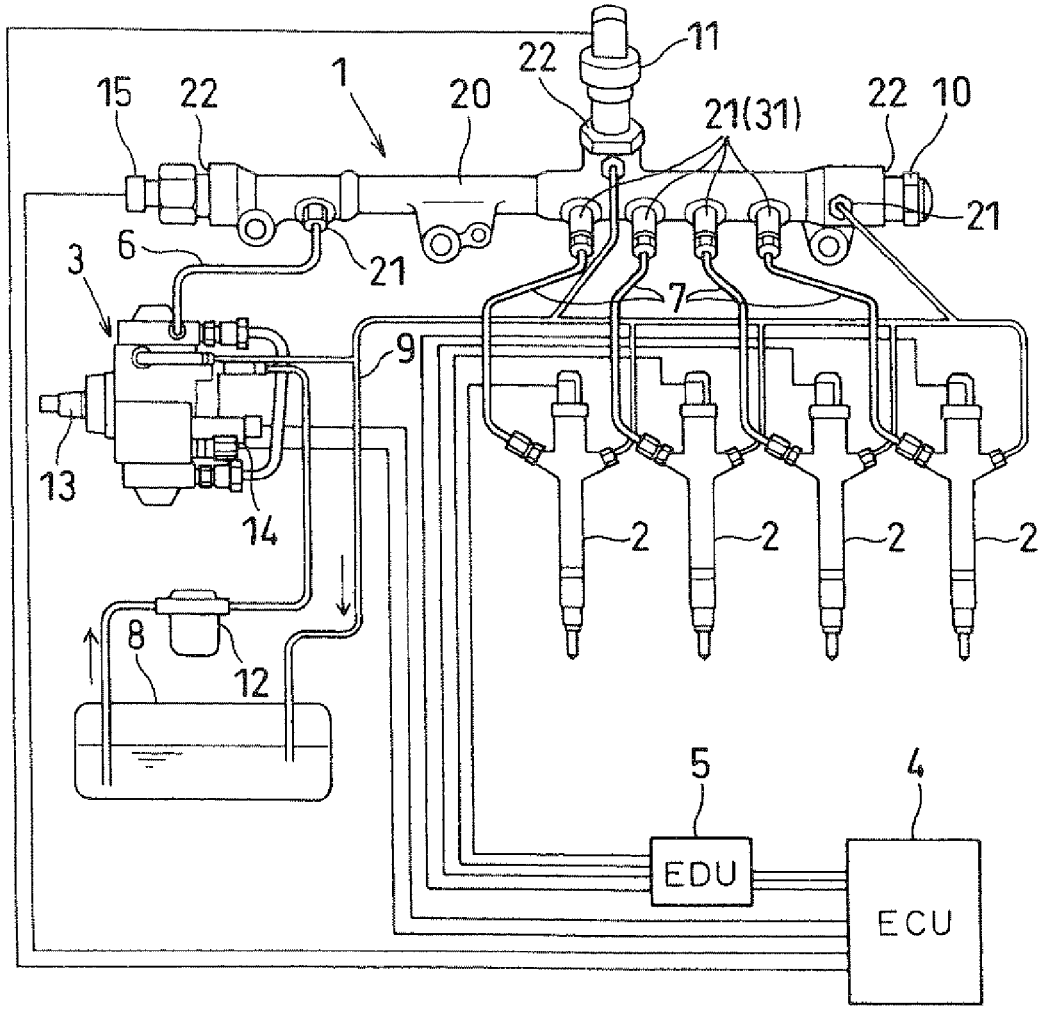
FIG. 3 is a schematic view illustrating a configuration of a common-rail fuel injection system according to the first embodiment.

The common-rail fuel injection system in FIG. 3 injects fuel into each cylinder of an engine, which is a diesel engine (not shown), for example. The common-rail fuel injection system includes a common rail 1, injectors 2, a supply pump 3, an engine electronic control unit (ECU) 4, and an electronic driver unit (EDU) 5.

The common rail 1 is a pressure accumulating container for accumulating pressure of high-pressure fuel, which is supplied to the injectors 2. The common rail 1 is connected to a discharge outlet of the supply pump 3, which force-feeds high-pressure fuel through a high-pressure pump pipe 6 in order to accumulate common rail pressure corresponding to fuel injection pressure. The common rail 1 is also connected to injector pipes 7, which supply high-pressure fuel to each of the injectors 2.

Flow dampers 31 are provided at corresponding connections between the common rail 1 and the injector pipes 7. The flow dampers 31 are described later in detail.

A pressure limiter 10 is attached to a relief pipe 9, through which fuel is returned to a fuel tank 8 from the common rail 1. The pressure limiter 10 is a pressure safety valve, which is opened to keep common rail pressure equal to or smaller than limit set pressure when common rail pressure is higher than the limit set pressure.

A decompression valve 11 is attached to the common rail 1. The decompression valve 11 is opened in response to a valve opening indication signal sent from the ECU 4 to rapidly decrease common rail pressure through the relief pipe 9. By attaching the decompression valve 11 to the common rail 1, the ECU 4 controls common rail pressure to be rapidly decreased to the pressure corresponding to a traveling condition of a vehicle. In addition, the decompression valve 11 is not provided for another model of the common rail.

Each of the injectors 2 is disposed in a corresponding cylinder of the engine, and injects and supplies fuel into the corresponding cylinder. The injectors 2 are connected to respective downstream ends of the injector pipes 7 that branch from the common rail 1. Each of the injectors 2 includes a fuel injection nozzle for injecting and supplying high-pressure fuel, pressure of which is accumulated in the common rail 1, into the corresponding cylinder, and an electromagnetic valve for controlling a lift of a needle received in the fuel injection nozzle.

In addition, leaking fuel from the injectors 2 is returned to the fuel tank 8 through the relief pipe 9.

The supply pump 3 is a high-pressure fuel pump, which force-feeds high-pressure fuel into the common rail 1. The supply pump 3 has a feed pump, which draws fuel in the fuel tank 8 to the supply pump 3 through a filter 12. The supply pump 3 compresses fuel that is drawn by the feed pump to have high pressure, and force-feeds the fuel into the common rail 1. The feed pump and the supply pump 3 are driven by a common camshaft 13. The camshaft 13 is driven to rotate by the engine.

The supply pump 3 has a fuel flow passage, which leads fuel into a compression chamber where fuel is pressurized to have high pressure. A suction control valve (SCV) 14 for regulating a degree of opening of the fuel flow passage is provided in the fuel flow passage. The SCV 14 is controlled by a pump drive signal from the ECU 4 to regulate an amount of fuel drawn into the compression chamber, thereby changing a discharge amount of fuel to be force-fed into the common rail 1. The SCV 14 regulates common rail pressure by regulating the discharge amount of fuel that is force-fed into the common rail 1. Accordingly, the ECU 4 controls common rail pressure to be the pressure, which corresponds to the traveling condition of the vehicle, by controlling the SCV 14.

The ECU 4 includes a central processing unit that performs control processing and arithmetic processing, a storage unit that stores various programs and data, for example, a ROM, a stand-by RAM, or memories such as an electrically erasable programmable ROM and RAM, and a microcomputer that has a known configuration and includes functions of an input circuit, output circuit, and power supply circuit. The ECU 4 performs arithmetic processing of various types based on signals from sensors loaded by the ECU 4, namely, engine parameters that are signals corresponding to an operating condition of an occupant and operating condition of the engine.

Sensors such as a rail pressure sensor 15 for detecting common rail pressure, an accelerator sensor for detecting a degree of opening of throttle valve, a rotational speed sensor for detecting a rotational speed of the engine, and a water temperature sensor for detecting coolant temperature of the engine are connected to the ECU 4 as means for detecting the operating condition and the like.

As an example of specific computing performed in the ECU 4, control by the ECU 4 includes an injector control system, in which the injectors 2 are controlled to be driven, and a rail pressure control system, in which the SCV 14 is controlled to be driven.

The injector control system calculates an injection pattern, target injection amount, and injection starting time and calculates an injector valve opening signal, based on programs stored in the ROM and the engine parameters loaded by the RAM with respect to each injection of fuel.

The rail pressure control system calculates target rail pressure based on programs stored in the ROM and the engine parameters loaded by the RAM. The rail pressure control system calculates an SCV drive signal for conforming real rail pressure, which is calculated using the rail pressure sensor 15, to the target rail pressure The EDU 5 includes an injector drive circuit and a pump drive circuit. The injector drive circuit passes a valve opening driving current through the electromagnetic valve of the injector 2 based on the injector valve opening signal sent from the ECU 4. The pump drive circuit passes a driving current through the SCV 14 based on the SCV drive signal (duty signal) sent from the ECU 4. The EDU 5 may be disposed in the same case as the ECU 4.

(Common Rail 1)

The common rail 1 includes a rail main body 20 having a pipe shape, in which superhigh pressure fuel is stored, and a pipe connecting means 21 for connecting the high-pressure pump pipe 6, the relief pipe 9, and the injector pipes 7 to the rail main body 20. Besides the pipe connecting means 21, the rail main body 20 has a functional component connecting portion 22 for attaching the pressure limiter 10, the decompression valve 11, and the rail pressure sensor 15 to the rail main body 20.

Additionally, the pressure limiter 10 and the decompression valve 11 may be provided integrally with the rail main body 20, or the decompression valve 11 does not need to be used.

As shown in FIG. 3, after forming the rail main body 20 by forging, and holes and planar portions, for example, an in-rail passage, a fuel hole 23, and a first plane 26 described below, may be formed on the rail main body 20. Alternatively, the rail main body 20 may be formed from an inexpensive piping material, and many pipe connecting means 21 may be provided for the piping material in its axial direction at low cost.

The rail main body 20 is made from hard metal such as iron, and the in-rail passage, which is a pressure accumulating chamber (not shown) for high-pressure fuel, is formed in the rail main body 20 in its longitudinal direction.

Figure 1:
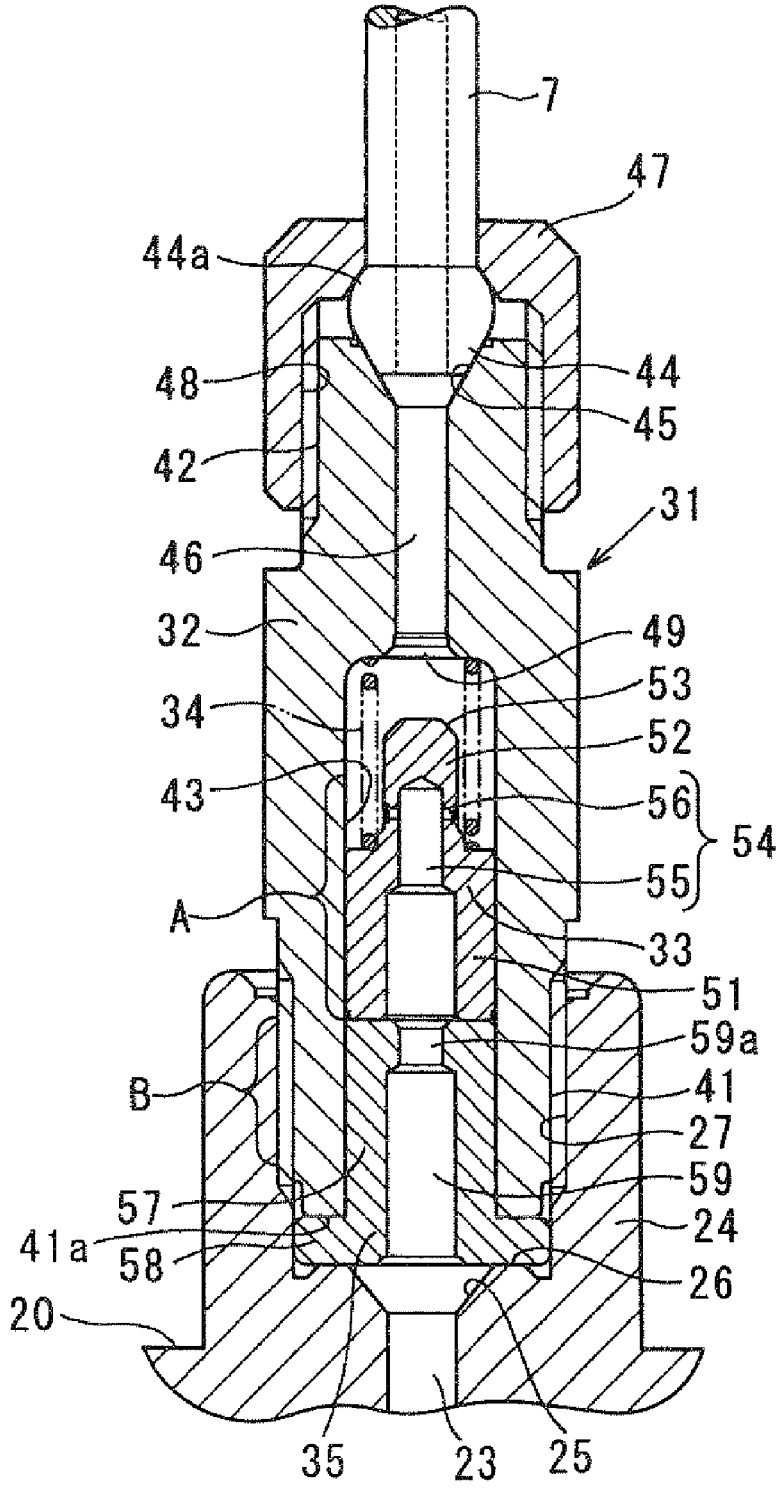
FIG. 1 is a sectional view illustrating a flow damper according to a first embodiment of the present invention.
Figure 2:
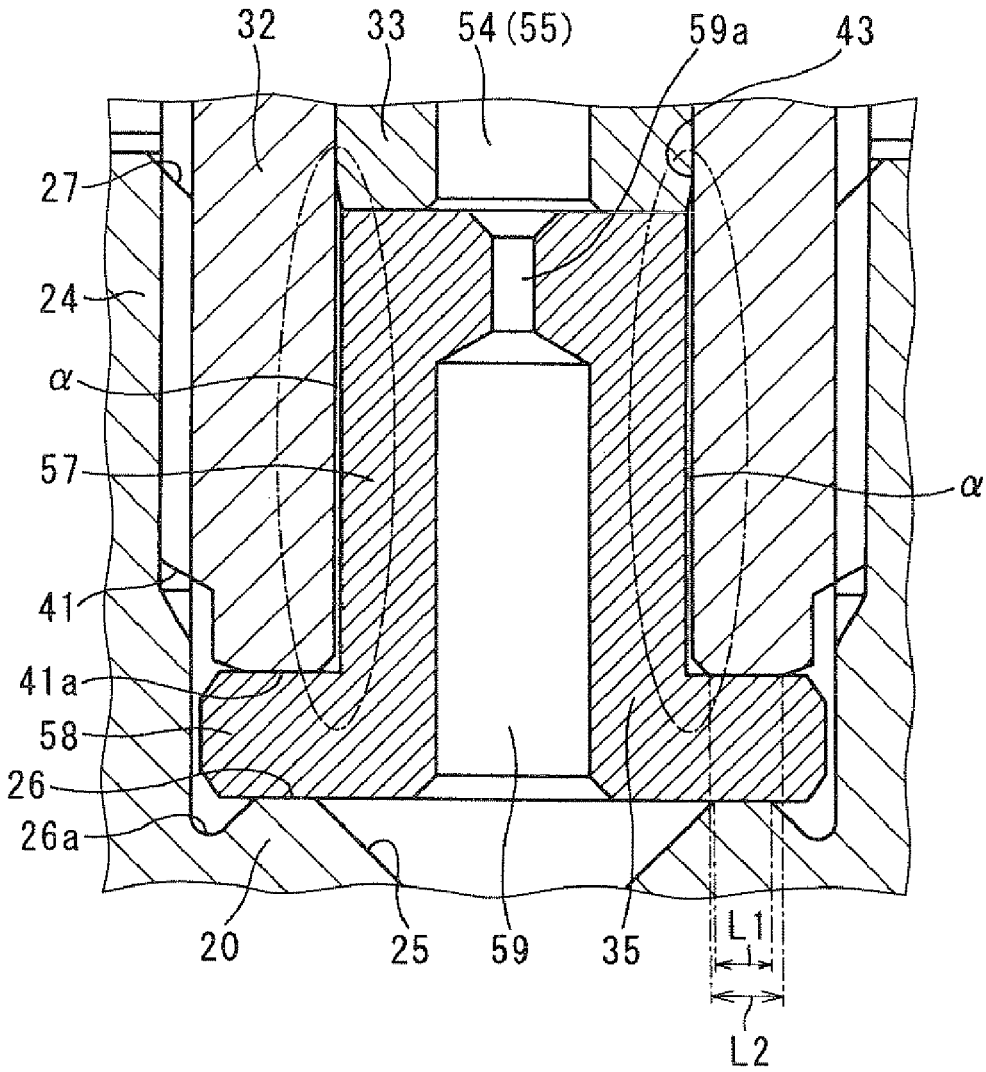
FIG. 2 is a sectional view illustrating a cap portion of the flow damper according to the first embodiment.

As shown in FIG. 1, the fuel holes 23, through which the in-rail passage and the outside communicate, are formed on a lateral surface of the rail main body 20. The fuel holes 23 communicate the high-pressure pump pipe 6, the relief pipe 9, and the injector pipes 7, and are formed by hole-drilling with an appropriate distance therebetween in an axial direction of the rail main body 20.

(Flow Damper 31)

The flow dampers 31 in FIG. 1 are respectively provided between the rail main body 20 and the injector pipes 7 for the pipe connecting means 21

The rail main body 20, to which the flow dampers 31 are attached, is described.

Cylindrical bosses 24 are formed with an appropriate distance therebetween on the rail main body 20 in its axial direction. The fuel hole 23 opens on a generally central portion of a bottom surface of the cylindrical boss 24.

A chamfered portion 25 spreading outward is formed at an outside opening of the fuel hole 23, and an opening area of the outside opening of the fuel hole 23 increases at the chamfered portion 25.

The annular first plane 26 is formed around the chamfered portion 25 on the bottom surface of the cylindrical boss 24.

A first female screw 27, with which the flow damper 31, more specifically, a valve body 32 described below, is fastened to the cylindrical boss 24, is formed on an inner circumferential surface of the cylindrical boss 24. In the embodiment, the cylindrical boss 24 is formed integrally with the rail main body 20. However, female screw components such as a nut may be fixed on and integrated with the rail main body 20 by welding or the like.

The flow damper 31 includes the valve body 32, a piston 33, a spring 34, and a cap 35. The valve body 32 is fastened to the rail main body 20. The piston 33 slides inside the valve body 32. The spring 34 urges the piston 33 upstream in a fuel flow direction. The cap 35 is attached to an upstream side-portion of the valve body 32 in the fuel flow direction.

Each component of the flow damper 31 is described in detail below, with a rail main body 20-side of the flow damper 31 referred to as 'lower' or 'down', and an injector pipe 7-side of the flow damper 31 as 'upper'. Nevertheless, these references to the directions are not related to an actual assemblage direction.

(Valve Body 32)

The valve body 32 having a generally cylindrical shape is made from hard metal such as iron, and has a fuel passage, which includes an upper fuel passage 46 and a piston sliding hole 43 described below, along its shaft axis.

A first male screw 41, which is screwed into the first female screw 27 of the rail main body 20, is formed on an outer circumferential surface of a lower portion of the valve body 32. A second male screw 42 for attaching the injector pipe 7 is formed on an outer circumferential surface of an upper portion of the valve body 32. A tool catching portion, for example, a hexagonal part, is formed on an outer circumferential surface of the valve body 32 between the first male screw 41 and the second male screw 42.

An annular plane 41*a* surrounding an opening of the piston sliding hole 43 is formed on a lower end portion of the first male screw 41.

A pressure receiving seating surface 45 is formed on an upper end portion of the second male screw 42. The pressure receiving seating surface 45 has a conical tapered shape, and a conical portion 44 formed at an end portion of the injector pipe 7 is inserted into the pressure receiving seating surface 45. The upper fuel passage 46 opens at the bottom of the pressure receiving seating surface 45.

A second female screw 48 formed on an inner circumferential surface of a pipe fastening screw member 47 is screwed on the second male screw 42.

The pipe fastening screw member 47 has a tool catching portion, for example, a hexagonal part on its outer circumferential surface. The pipe fastening screw member 47 is screwed on the second male screw 42, being locked on a step 44*a* of the conical portion 44 of the injector pipe 7. By strongly screwing the pipe fastening screw member 47 on the second male screw 42, the conical portion 44 of the injector pipe 7 is strongly pressed on the pressure receiving seating surface 45, thereby forming a pipe sealing surface, which is an oil-tight surface, or a closely-attached surface between the injector pipe 7 and the valve body 32.

The piston sliding hole 43 for slidably holding the piston 33 in its axial direction between a lower end portion and generally central portion of the valve body 32 is formed along the shaft axis of the valve body 32. The upper fuel passage 46, which communicates between an upper end portion of the valve body 32 and the piston sliding hole 43, is formed above the central portion of the valve body 32. The upper fuel passage 46 and the piston sliding hole 43 constitute the fuel passage in the valve body 32.

A valve sheet 49 having a generally conical shape and spreading downward is formed between the upper fuel passage 46 and the piston sliding hole 43. The piston sliding hole 43 and the upper fuel passage 46 are formed coaxially with each other, thereby keeping the valve sheet 49 of the valve body 32 and a valve portion 53 (described later) of the piston 33 coaxial with each other.

(Piston 33)

The piston 33 is made from materials that are not damaged under high pressure of fuel, such as iron, aluminum, and resin. The piston 33 is slidably held in its axial direction in the piston sliding hole 43 of the valve body 32. The piston 33 includes a large diameter sliding portion 51 and a projecting portion 52 with a step between the large diameter sliding portion 51 and the projecting portion 52. The large diameter sliding portion 51 located on a lower side of the piston 33 slides directly on the piston sliding hole 43. The projecting portion 52 located on an upper side of the piston 33 has a smaller diameter. The valve portion 53, which engages the valve sheet 49 of the valve body 32 to block the upper fuel passage 46, is formed on an upper end portion of the projecting portion 52. A lower end portion of the spring 34 contacts the step between the large diameter sliding portion 51 and the projecting portion 52, so that the piston 33 is urged downward by the spring 34.

A throttle passage 54, which communicates between a lower surface of the large diameter sliding portion 51 and a lateral surface of the projecting portion 52, is formed in the piston 33. The throttle passage 54 includes a piston central hole 55 and a throttle 56, which is an orifice of the piston central hole 55. The piston central hole 55 extends from a generally central portion of the lower surface of the large diameter sliding portion 51 to a halfway position of the projecting portion 52. The throttle 56 communicates between the piston central hole 55 and the outer circumferential surface of the projecting portion 52.

(Spring 34)

The spring 34 is a compression coil spring, which urges the piston 33 downward. An actuation value of the flow damper 31, which is a set value for blocking of an outflow of high-pressure fuel by the flow damper 31, is set according to a compressive load of the spring 34. The actuation value of the flow damper 31 may be set according to a diameter of the throttle 56, length of the projecting portion 52 in its axial direction, or a diameter of an orifice 59*a* (described below) of the cap 35, in addition to the compressive load of the spring 34.

(Cap 35)

The cap 35 is made from hard metal having good sealing characteristics, such as iron and copper, and attached to the upstream side-portion of the valve body 32 in the fuel flow direction. The cap 35 includes a small diameter portion 57, which is a stopper portion fitted into an inner circumferential surface of the piston sliding hole 43, a large diameter portion 58, which is a gasket portion located between the valve body 32 and the rail main body 20, and the orifice 59*a* in a communicating portion 59, which communicates between the fuel hole 23 of the rail main body 20 and an upstream side of the fuel passage.

The small diameter portion 57 has a generally cylindrical shape. An outer diameter of the small diameter portion 57 is slightly smaller than an inner diameter of the piston sliding hole 43. In a portion surrounded with a dotted and dashed oval in FIG. 2, the small diameter portion 57 is fitted into the piston sliding hole 43 with a small gap $\alpha$ therebetween. More specifically, the gap ax between the small diameter portion 57 and the piston sliding hole 43 is set such that, even if the valve body 32 is strongly fastened to the rail main body 20 and consequently a lower portion of the valve body 32 is strained and has a decreased diameter, the piston sliding hole 43 does not press the outer circumferential surface of the small diameter portion 57.

The small diameter portion 57 serves as a stopper for restricting displacement of the piston 33 toward the upstream side in the fuel flow direction. A lower end plane of the piston 33 directly engages a stopper surface, which is an upper end plane of the small diameter portion 57. In other words, a stopper, which is another component, is not disposed between the cap 35 and the piston 33.

Length of the small diameter portion 57 in its axial direction is set such that a direct sliding range A, in which the piston 33 slides directly in the valve body 32, does not overlap with a screwed range B (range in the valve body 32, in which a stress is generated due to fastening force), in which the valve body 32 is screwed into the rail main body 20, in an axial direction of the valve body 32. In other words, the length of the small diameter portion 57 in its axial direction, or insertion length of the small diameter portion 57 is set, such that an upper end position of the cap 35, which is the stopper surface that the piston 33 engages, is located above an upper end position of the first female screw 27 of the cylindrical boss 24, with the valve body 32 fastened to the rail main body 20.

In the first embodiment, the upper end position of the cap 35 is located above the upper end position of the first female screw 27 in the fastened state between the valve body 32 and the rail main body 20. Alternatively, since a portion of the valve body 32 strained by fastening force is located in a lower area of the screwed range B, the upper end position of the cap 35 may be located above an upper third of the screwed range B, or above a half of the screwed range B.

The large diameter portion 58 is a ring flange having a slightly smaller diameter than an inner diameter of the cylindrical boss 24. By fastening the valve body 32 to the rail main body 20, the large diameter portion 58 is pressed between the valve body 32 and the rail main body 20 to serve as a gasket. More specifically, upper and lower surfaces of the large diameter portion 58 are formed to be annularly planar, and are pressed between the first plane 26 of the rail main body 20 and the annular plane 41*a* of the first male screw 41. By screwing the first male screw 41 of the valve body 32 strongly into the first female screw 27 of the rail main body 20, a main body sealing surface, which is an oil-tight surface, or a closely-attached surface where a contact area between the first plane 26 and the large diameter portion 58 and a contact area between the annular plane 41*a* and the large diameter portion 58 are strongly pressed together, is formed As shown in FIG. 2, a diameter of the chamfered portion 25 at its upper end is made large, and an annular groove 26*a* is formed around the first plane 26. As a result, a radial width L1 of the first plane 26 is smaller than a radial width L2 of the annular plane 41*a*, and thereby the annular plane 41*a* covers the first plane 26 when viewed in the axial direction.

Even if assemblage positions of the first plane 26 and the annular plane 41*a* are misaligned in their radial direction within a manufacturing error range, the annular plane 41*a* covers the first plane 26 when viewed in the axial direction. Accordingly, a constantly stable axial load is applied to the entire circumferential portion of the large diameter portion 58. As a result, application of an unbalanced load or shear load to the large diameter portion 58 is avoided, thereby ensuring stable sealing force on the large diameter portion 58.

The communicating portion 59, through which high-pressure fuel in the fuel hole 23 of the rail main body 20 flows to an upstream side of the piston 33, that is, into the piston central hole 55, is formed in the center of the cap 35. The orifice 59*a* for reducing a flow passage area of the communicating portion 59 is formed in an upper area of the communicating portion 59 to restrict promotion of pulsing motion in the injector pipe 7 due to movement of the piston 33 involved in a fuel flow generated when the injector 2 injects fuel.

The orifice 59*a* is a shaft hole having a small diameter, which is formed at an upper portion of the cap 35, and has chamfered portions at its both ends. The chamfered portions are for preventing burrs, and preventing damage to corner portions at the both ends of the orifice 59*a* from concentration of stress when high-pressure fuel flows through the cap 35. The lower chamfered portion, that is, the chamfered portion in the communicating portion 59, is formed by a conical portion at an end of a drill bit, which forms the communicating portion 59. Thus, only the upper chamfered portion, which is exposed outside, needs to be chamfered. Accordingly, chamfering is easily performed, and thereby a cost rise caused by the chamfering is restricted.

Since the orifice 59*a* is formed at an end portion of the cap 35, or an upper end portion of the cap 35 in the first embodiment, an orifice diameter is easily recognized with eyes when the cap 35 is separated. Accordingly, the position of the orifice 59*a* serves to prevent an erroneous assemblage, and in a flow adjustment described below, the orifice diameter is easily changed, that is, the cap 35 is easily replaced.

(Workings of the Flow Damper 31)

When a fuel flow in a downstream direction is small, such as in the case of micro injection, a pressure difference between before and after the throttle passage 54 is small, so that the piston 33 engages the small diameter portion 57 of the cap 35. In the above state, fuel supplied to the piston central hole 55 through the communicating portion 59 flows to the injector 2 after passing through the throttle passage 54 alone.

When the fuel flow in the downstream direction increases in a normal range, such as in the case of extensive injection, the pressure difference between before and after the throttle passage 54 increases, so that the piston 33 disengages from the cap 35 to be displaced to the upper side, or to the downstream side. In the above state, fuel that have passed through the communicating portion 59 is supplied to the injector 2 after passing through the throttle passage 54 and through a sliding clearance between the large diameter sliding portion 51 of the piston 33 and the piston sliding hole 43.

When the fuel flow in the downstream direction abnormally increases because of malfunction of the injector 2 such as an excessive fuel outflow and accordingly the pressure difference between before and after the throttle passage 54 is equal to or larger than a predetermined pressure difference, the piston 33 is displaced to the upper side, so that the valve portion 53 located on the upper end portion of the projecting portion 52 engages the valve sheet 49 of the valve body 32 to block the upper fuel passage 46.

In this manner, when the fuel flow in the downstream direction increases to equal to or larger than a predetermined amount due to some failure of the flow damper 31 by any possibility, the flow damper 31 stops the outflow of high-pressure fuel.

Effect of the First Embodiment

The valve body 32 is firmly fastened to the rail main body 20 to prevent leakage of high-pressure fuel without fail. Accordingly, a lower side of the valve body 32 is strained because of strong axial force by the fastening and the rotating slide, and plastic deformation is caused near a lower end of the valve body 32.

The piston sliding hole 43 formed in the valve body 32 slidably holds the large diameter sliding portion 51 of the piston 33. The sliding clearance between the large diameter sliding portion 51 and the piston sliding hole 43 is set to be small, for example, in a range of 10 to 20 μm in order to improve coaxial accuracy. As a result, when the direct sliding range A is deformed in a radially inward direction, the sliding clearance is decreased, thereby deteriorating the slide of the piston 33.

In the first embodiment, as described above, the small diameter portion 57 of the cap 35 is inserted into the piston sliding hole 43 through a lower side of the piston sliding hole 43. A lower stop position of the piston 33 is set at a position, which is a predetermined distance away toward the upper side from a lower opening end of the piston sliding hole 43, according to the insertion length of the small diameter portion 57. More specifically, the length of the small diameter portion 57 in its axial direction in the first embodiment is set, such that the direct sliding range A does not overlap with the screwed range B in the axial direction. Accordingly, a portion of the valve body 32 deformed when fastened does not overlap with the direct sliding range A, in which the piston 33 slides directly in the valve body 32, in the axial direction.

In this manner, by inserting and disposing the small diameter portion 57 into an inner circumferential surface of the piston sliding hole 43, the portion of the valve body 32 deformed when fastened does not overlap with the direct sliding range A in the axial direction. As a result, even if the valve body 32 is deformed by fastening force, the deformation does not reach the direct sliding range A, so that slide failure of the piston 33 is not caused.

The cap 35 in the flow damper 31 of the first embodiment is fixed by sandwiching the large diameter portion 58 between the valve body 32 and the rail main body 20. The small diameter portion 57 is fitted into the inner circumferential surface of the piston sliding hole 43. Accordingly, when it is examined whether the flow damper 31 that has been produced works within an appropriate range, the cap 35 is separated from the valve body 32 if the flow damper 31 turns out to be faulty (NG). As a result, replacement of the cap 35 (change of the orifice diameter), replacement of the piston 33 (change of a throttle passage diameter), or replacement of the spring 34 (change of a set load) is easily done.

As a specific example, since the diameter (orifice diameter) of the orifice 59*a* formed in the cap 35 is for controlling a flow of fuel flowing from the common rail 1 into the injector 2, the flow is examined with the valve body 32 fastened to the rail main body 20. When the flow damper 31 has a poor flow characteristic (NG) in the examination results, the orifice diameter is changed by replacing only the cap 35 that is fitted. Thus, the flow characteristic of the flow damper 31 is regulated to be within the appropriate range by the replacement of the cap 35 (change of the orifice diameter).

In the conventional art, the whole faulty flow damper 31 needs to be disposed of. However, in the first embodiment, by replacing only a part of components, to which the fault in the flow damper 31 is attributed, the flow damper 31 is regulated to be within the appropriate range.

Furthermore, because the cap 35, the piston 33, and the spring 34 can be replaced, general versatility of the flow damper 31 is improved, and thereby the cost rise in the flow damper 31 is restricted as well.

Second Embodiment

A second embodiment of the present invention is described below with reference to FIGS. 4A, 4B. In the second embodiment, the same numeral as the first embodiment indicates the same component.

Figure 4A:
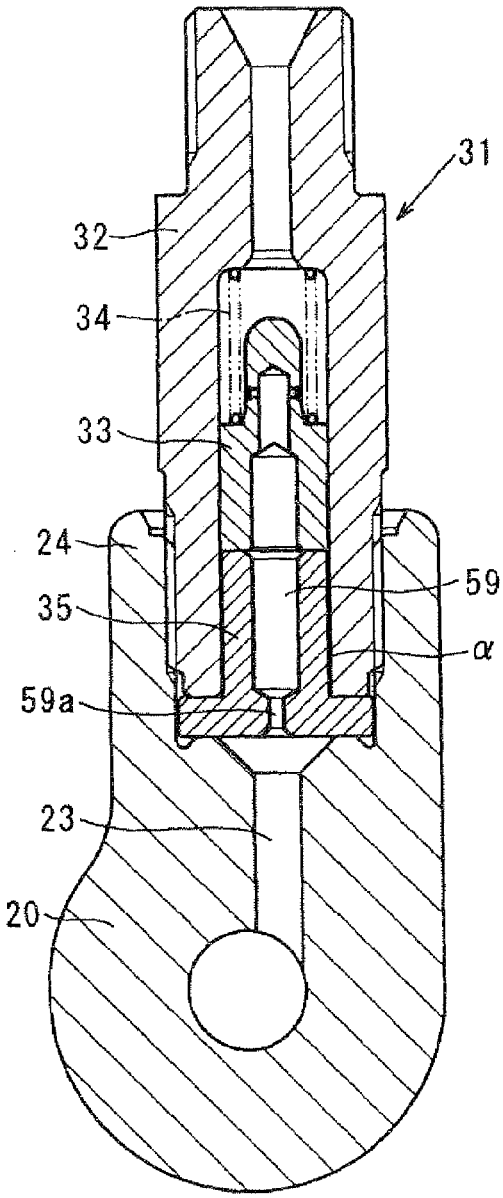
FIG. 4A is a sectional view illustrating a flow damper according to a second embodiment of the present invention.
Figure 4B:
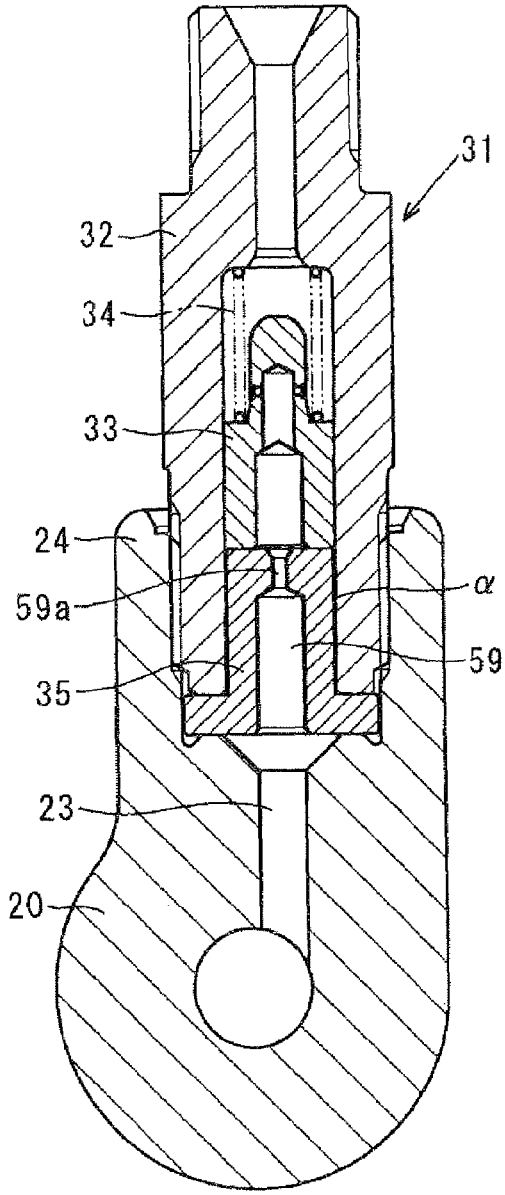
FIG. 4B is a sectional view illustrating the flow damper according to the first embodiment.

In the above first embodiment, as shown in FIG. 4B, the orifice 59*a* is formed in an upper end portion (on a piston 33-side) of the cap 35.

In the second embodiment, as shown in FIG. 4A, an orifice 59*a* is formed in a lower end portion (on a rail main body 20-side) of a cap 35.

By forming the orifice 59*a* in this manner as well, a similar effect to the first embodiment is produced.

More specifically, an upper chamfered portion of the orifice 59*a* is formed by a conical portion at an end of a drill bit, which forms a communicating portion 59. Accordingly, only a lower chamfered portion exposed outside needs to be chamfered. Similar to the first embodiment, the chamfering is easily performed, and thereby the cost rise caused by the chamfering is restricted.

Because the orifice 59*a* is formed in the lower end portion of the cap 35, the orifice diameter is easily recognized with eyes, similar to the first embodiment. Accordingly, in the flow adjustment, the orifice diameter is easily changed, that is, the cap 35 is easily replaced.

MODIFICATIONS

In the above embodiments, the small diameter portion 57 has constant outer diameter. Alternatively, the small diameter portion 57 may have another shape. For example, an outer diameter of the small diameter portion 57 on its upper side may be formed to be smaller than the one on its lower side.

In the above embodiments, the orifice 59*a* is formed in the upper or lower end portion of the cap 35, and thereby the orifice diameter is easily recognized with eyes. Alternatively, although the visibility of the orifice diameter is decreased, the orifice 59*a* may be formed in a middle portion of the cap 35 in its axial direction.

Figure 5:
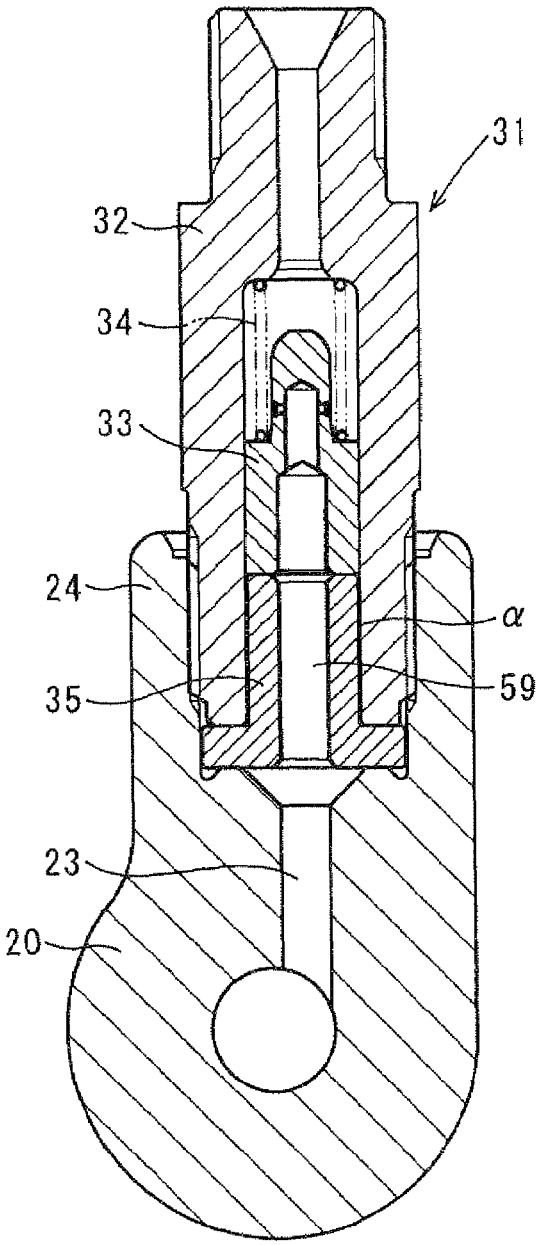
FIG. 5 is a sectional view illustrating a modified example of the flow damper.
Figure 6:
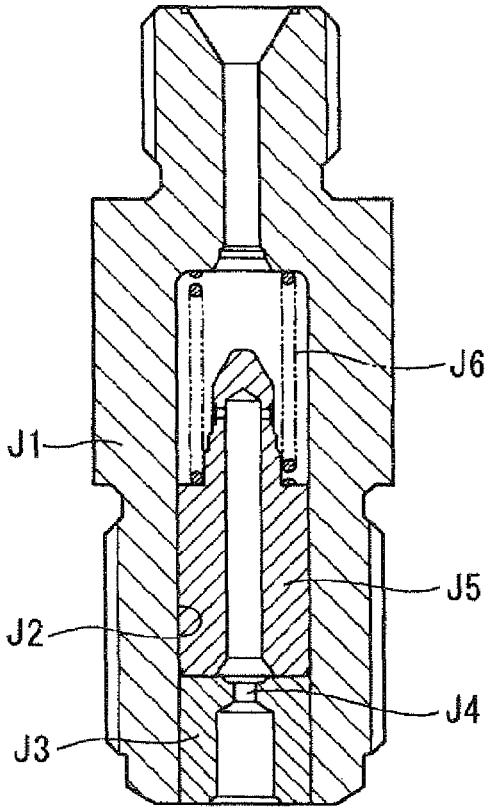
FIG. 6 PRIOR ART
FIG. 6 is a sectional view illustrating a previously proposed flow damper.

In the above embodiments, the orifice 59*a* is formed in the cap 35. However, as shown in FIG. 5, the orifice 59*a* may be unnecessary in the cap 35.

Additional advantages and modifications will readily occur to those skilled in the art. The invention in its broader terms is therefore not limited to the specific details, representative apparatus, and illustrative examples shown and described.

What is claimed is:

1. A flow damper for controlling a flow of fuel flowing from a rail main body that accumulates pressure of high-pressure fuel into an injector that injects fuel, the flow damper comprising:

a valve body that is fastened to the rail main body and has a fuel passage therein, wherein:

the fuel passage communicates between a fuel hole of the rail main body and the injector; and the fuel passage includes a piston sliding hole on its rail main body-side;

a piston that is slidably held on an inner circumferential surface of the piston sliding hole;

a spring that urges the piston in an opposite direction from a direction of fuel flowing through the fuel passage; and a cap that includes a small diameter portion and a large diameter portion, wherein:

the small diameter portion is fitted into the inner circumferential surface of the piston sliding hole with a gap between the small diameter portion and the piston sliding hole;

the large diameter portion is located between the valve body and the rail main body; and length of the small diameter portion in its axial direction is set such that a direct sliding range, in which the piston directly slides on the inner circumferential surface of the piston sliding hole of the valve body, does not overlap with a screwed range, in which the valve body is screwed into the rail main body, in an axial direction of the valve body.

2. The flow damper according to claim 1, wherein:

the cap further includes a communicating portion that communicates between the fuel hole and an upstream side of the piston sliding hole in the direction of fuel; and the communicating portion has an orifice.

3. The flow damper according to claim 1, wherein the small diameter portion serves as a stopper for restricting displacement of the piston in the opposite direction from the direction of fuel.

* * * * *